US011029032B2

(12) United States Patent
Harrell

(10) Patent No.: US 11,029,032 B2
(45) Date of Patent: Jun. 8, 2021

(54) STOVE

(71) Applicant: Dometic Sweden AB, Solna (SE)

(72) Inventor: Dustin Harrell, Goodlettsville, TN (US)

(73) Assignee: Dometic Sweden AB, Solna (SE)

( * ) Notice: Subject to any disclaimer, the term of this patent is extended or adjusted under 35 U.S.C. 154(b) by 0 days.

(21) Appl. No.: 16/196,430

(22) Filed: Nov. 20, 2018

(65) Prior Publication Data

US 2019/0154264 A1 May 23, 2019

Related U.S. Application Data

(60) Provisional application No. 62/589,769, filed on Nov. 22, 2017.

(51) Int. Cl.
*F24C 3/00* (2006.01)
*F24C 15/10* (2006.01)

(52) U.S. Cl.
CPC ..... *F24C 3/002* (2013.01); *F24C 15/108* (2013.01)

(58) Field of Classification Search
CPC ..... F24C 3/002; F24C 15/108; A47B 77/02; A47B 77/06; A47B 77/08
USPC ..... 126/37 R, 50, 22, 273 A, 114
See application file for complete search history.

(56) References Cited

U.S. PATENT DOCUMENTS 3,142,295 A * 7/1964 Blee ..... A47B 77/08 126/37 R
5,119,802 A 6/1992 Cherry et al.
5,257,228 A 10/1993 Sukegawa
D343,336 S 1/1994 Falk
D369,062 S 4/1996 Holbrook, Jr.
D392,502 S 3/1998 Ashcraft et al.
D393,774 S 4/1998 Ashcraft et al.
5,931,151 A * 8/1999 Van Dore ..... F24C 15/30 126/214 A
D479,781 S 9/2003 Pottenger et al.
D479,942 S 9/2003 Pottenger et al.
D480,261 S 10/2003 Pottenger et al.
D495,202 S 8/2004 Becker et al.
D510,227 S 10/2005 Baldwin
D524,601 S 7/2006 Vetter
D538,581 S 3/2007 Lee
D564,838 S 3/2008 Shin et al.
(Continued)

FOREIGN PATENT DOCUMENTS

CN 304863114 S 10/2018

OTHER PUBLICATIONS

Dometic 2016 Product Catalogue, Cooking, pp. 95-96. Nov. 16, 2015.

(Continued)

*Primary Examiner* — Alfred Basichas
(74) *Attorney, Agent, or Firm* — Middleton Reutlinger

(57) ABSTRACT

The present embodiments provide for a stove which may be installed in a countertop mount or recessed configuration. The stove provides an end cap which is connected to or mounted adjacent to a front control panel. In one configuration, the end cap may be utilized in a configuration to receive a portion of the adjacent edges of the countertop. Alternatively, in flush fit configuration, the end caps may be closed so that no opening is clearly shown and the end caps are positioned adjacent to the countertop but do not receive such.

12 Claims, 10 Drawing Sheets

(56) References Cited

U.S. PATENT DOCUMENTS

| | | | |
|---|---|---|---|
| D580,225 | S | 11/2008 | Geiger et al. |
| D599,608 | S | 9/2009 | Grumm et al. |
| D622,537 | S | 8/2010 | Kim et al. |
| D628,017 | S | 11/2010 | Funnell et al. |
| D628,431 | S | 12/2010 | Funnell et al. |
| D629,638 | S | 12/2010 | Funnell et al. |
| D634,579 | S | 3/2011 | Funnell et al. |
| D642,418 | S | 8/2011 | Kim et al. |
| D684,424 | S | 6/2013 | Funnell et al. |
| D722,818 | S | 2/2015 | Pionek et al. |
| D722,820 | S | 2/2015 | Pionek et al. |
| D724,382 | S | 3/2015 | Pionek et al. |
| D731,845 | S | 6/2015 | Kim et al. |
| D736,553 | S | 8/2015 | Funnell, II et al. |
| D752,386 | S | 3/2016 | Pionek et al. |
| D755,009 | S | 5/2016 | Kim et al. |
| D763,616 | S | 8/2016 | Kim et al. |
| D765,459 | S | 9/2016 | Shoemaker et al. |
| D771,437 | S | 11/2016 | Segers et al. |
| D773,232 | S | 12/2016 | Shoemaker et al. |
| D778,111 | S | 2/2017 | Shoemaker et al. |
| D779,262 | S | 2/2017 | Kim et al. |
| D781,648 | S | 3/2017 | Shoemaker |
| D786,609 | S | 5/2017 | Cho et al. |
| D787,255 | S | 5/2017 | Cho et al. |
| D798,108 | S | 9/2017 | Shoemaker et al. |
| D798,662 | S | 10/2017 | Shoemaker et al. |
| D804,245 | S | 12/2017 | Segers et al. |
| D808,707 | S | 1/2018 | Kim et al. |
| D810,493 | S | 2/2018 | Harrell et al. |
| D811,165 | S | 2/2018 | Sadtler |
| D812,415 | S | 3/2018 | Best et al. |
| D812,958 | S | 3/2018 | Kim et al. |
| D812,959 | S | 3/2018 | Kim |
| D816,386 | S | 5/2018 | Kim |
| D817,066 | S | 5/2018 | Shoemaker |
| D817,685 | S | 5/2018 | Incukur |
| D817,691 | S | 5/2018 | Kim et al. |
| D821,802 | S | 7/2018 | Jeon et al. |
| D829,482 | S | 10/2018 | Incukur |
| D835,932 | S | 12/2018 | Incukur |
| D839,038 | S | 1/2019 | Bell |
| D840,738 | S | 2/2019 | Chung et al. |
| D843,159 | S | 3/2019 | Kim et al. |
| D846,944 | S | 4/2019 | Incukur |
| D851,439 | S | 6/2019 | Harrell et al. |
| D851,978 | S | 6/2019 | Bell |
| D851,979 | S | 6/2019 | Bell |
| D855,379 | S | 8/2019 | Kim et al. |
| D857,452 | S | 8/2019 | Sadtler |
| D859,054 | S | 9/2019 | Kim et al. |
| D863,882 | S | 10/2019 | Kim et al. |
| D872,516 | S | 1/2020 | Bell |
| D873,062 | S | 1/2020 | Bell |
| 10,527,292 | B2 | 1/2020 | Bell |
| D874,209 | S | 2/2020 | Harrell et al. |
| D874,220 | S | 2/2020 | Kim et al. |
| D874,865 | S | 2/2020 | Lim et al. |
| D893,238 | S | 8/2020 | Bell |
| D894,663 | S | 9/2020 | Harrell et al. |
| D896,018 | S | 9/2020 | Harrell et al. |
| 2011/0120446 | A1 | 5/2011 | Simms et al. |
| 2019/0383497 | A1 | 12/2019 | Cowan et al. |

OTHER PUBLICATIONS

Restriction Requirement issued in U.S. Appl. No. 29/627,084 dated Oct. 11, 2018.
Restriction Requirement mailed in Design U.S. Appl. No. 29/627,085 dated Oct. 31, 2018.
Notice of Allowance mailed in Design U.S. Appl. No. 29/627,085 dated Jan. 24, 2019.
Notice of Allowance issued in U.S. Appl. No. 29/627,084 dated Jul. 15, 2019.
Notice of Allowance issued in Design U.S. Appl. No.29/627,084 dated Oct. 2, 2019.
Restriction Requirement mailed in Design U.S. Appl. No. 29/627,123 dated Oct. 15, 2019.
Chinese Patent Application No. 201830235109.2 filed May 21, 2018 entitled "Stove" (Machine Translation Attached).
Chinese Patent Application No. 201830235110.5 filed May 21, 2018 entitled "Stove Grate" (Machine Translation Attached).
Design U.S. Appl. No. 29/627,084, filed Nov. 22, 2017 entitled "Stove".
Design U.S. Appl. No. 29/627,123, filed Nov. 22, 2017 entitled "Stove".
Design U.S. Appl. No. 29/633,001, filed Jan. 11, 2018 entitled "Cooktop Cover".
Design U.S. Appl. No. 29/690,322, filed May 7, 2019 entitled "Stove".
Design U.S. Appl. No. 29/690,324, filed May 7, 2019 entitled "Stove".
U.S. Appl. No. 62/589,769, filed Nov. 22, 2017 entitled "Stove".
Design U.S. Appl. No. 29/715,462, filed Dec. 2, 2019 entitled "Stove Grate".
Notice of Allowance issued in Design U.S. Appl. No. 29/744,797 dated Jan. 13, 2021.
Notice of Allowance issued in Design U.S. Appl. No. 29/627,123 dated Apr. 7, 2020.
Notice of Allowance issued in Design U.S. Appl. No. 29/690,324 dated Apr. 15, 2020.
Notice of Allowance issued in Design U.S. Appl. No. 29/690,322 dated Apr. 15, 2020.
Notice of Allowance issued in Design U.S. Appl. No. 29/627,123 dated May 11, 2020.
Notice of Allowance issued in Design U.S. Appl. No. 29/690,324 dated May 8, 2020.
Notice of Allowance issued in Design U.S. Appl. No. 29/690,322 dated May 8, 2020.
Notice of Allowance issued in Design U.S. Appl. No. 29/627,123 dated Jun. 19, 2020.
Notice of Allowance issued in Design U.S. Appl. No. 29/690,322 dated Jun. 19, 2020.
Notice of Allowance issued in Design U.S. Appl. No. 29/690,324 dated Jun. 17, 2020.
Notice of Allowance issued in Design U.S. Appl. No. 29/627,123 dated Aug. 19, 2020.
Design U.S. Appl. No. 29/744,797, filed Jul. 31, 2020 entitled "Stove".
Notice of Allowance issued in Design U.S. Appl. No. 29/715,462 dated Mar. 3, 2021.
Corrected Notice of Allowance issued in U.S. Appl. No. 29/715,462 dated Mar. 30, 2021.
Corrected Notice of Allowance for U.S. Appl. No. 29/744,797 dated Apr. 12, 2021.

* cited by examiner

STOVE

CLAIM TO PRIORITY

This non-provisional patent application claims priority to and benefit of, under 35 U.S.C. § 119(e), U.S. Provisional Patent Application Ser. No. 62/589,769, filed Nov. 22, 2017 and titled "Stove", all of which is incorporated by reference herein.

BACKGROUND

1. Field of the Invention

Present embodiments relate to a stove for use in mobile vehicle applications. More specifically, but without limitation, present embodiments relate to a stove which may be utilized either as a slide-in/flush fit relative to a countertop or as a drop-in arrangement supported by the countertop wherein a countertop has an overhang relative to an adjacent cabinet arrangement.

2. Description of the Related Art

Various recreational vehicles (RVs) utilize stoves which may be provided by the original equipment manufacturer (OEM) in the RV. Alternatively, the stoves may be sold as an aftermarket replacement item to the end user. The stoves generally may have two types of installation. Some stoves are sold for installation wherein the cooktop rests above the countertop surface, while others are sold for installation below the countertop surface. Accordingly, this requires two different stoves to be manufactured to accommodate both types of installation, which is out of the control of the stove manufacturer. In addition, the stoves may be provided with or without an oven portion of the appliance.

It would be desirable to provide a device which can accommodate differing types of installations of countertop and cabinet arrangements for improving the installation process of the stove or stove and oven combination appliance.

Additionally, it would be desirable to allow for a single oven type rather than two types necessary to accommodate the differing installations.

Still further, it would be desirable to provide an assembly which allows for a user to choose whether to use a cover or not use a cover with the installation of the oven.

The information included in this Background section of the specification, including any references cited herein and any description or discussion thereof, is included for technical reference purposes only and is not to be regarded subject matter by which the scope of the invention is to be bound.

SUMMARY

The present application discloses one or more of the features recited in the appended claims and/or the following features which alone or in any combination, may comprise patentable subject matter.

The present embodiments provide for a stove which may be installed in a countertop mount or recessed configuration. The stove provides an end cap which is connected to or mounted adjacent to a front control panel. The end cap has two configurations which allows for different type of countertop/cabinet installations. In one configuration, the end cap may be utilized in a notched configuration to receive a portion of the adjacent edges of the countertop. This may be suitable where the countertop overhangs the edge of the cabinets. Alternatively, in a flush fit configuration, which is common in recessed mounting, the end caps may be closed so that no opening is necessary and the end caps are positioned adjacent to the countertop but do not receive such.

According to some embodiments, a stove comprises an appliance housing configured to be positioned within an opening in a cabinet arrangement, a pan having a plurality of burners, a front facing control panel, having a plurality of valve controls adjacent to the front facing control panel, an end cap disposed near at least one end of the control panel, the end cap having an opening, wherein in one configuration, the opening can receive an edge of a countertop and in a second configuration, the opening may be closed with a plate for a flush fit of an edge of the countertop or cabinet arrangement.

Some optional embodiments may be utilized with the previous embodiment either alone or in combination with other embodiments. According to some embodiments, the stove opening may be formed in an enclosure. The edge of the countertop may pass through an outer vertical plane defined by the end cap and the opening. The plate may have at least one connector. The plate may have a first leg and a second leg extending from a rear surface of the plate and extending through the opening of said end cap. The stove may further comprise a second end cap. The stove may further comprise a bracket which is positioned near ends of the control panel, the bracket connected to the end cap and the second end cap. The bracket may retain valves in position relative to the control panel and valve controls. The end caps may have one of a male or female connector and the first and second legs may have the other of the male and female connector. The end cap may have a design feature which matches a design feature of one of the burner pan and the control panel. The design feature may be a chamfer.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of present embodiments is provided in the following written description, illustrated in the accompanying drawings, and defined in the appended claims.

BRIEF DESCRIPTION OF THE DRAWINGS

In order that the embodiments may be better understood, embodiments of a stove will now be described by way of examples. These embodiments are not to limit the scope of the claims as other embodiments of a stove will become apparent to one having ordinary skill in the art upon reading the instant description. Non-limiting examples of the present embodiments are shown in figures wherein:

DETAILED DESCRIPTION

Figure 1:
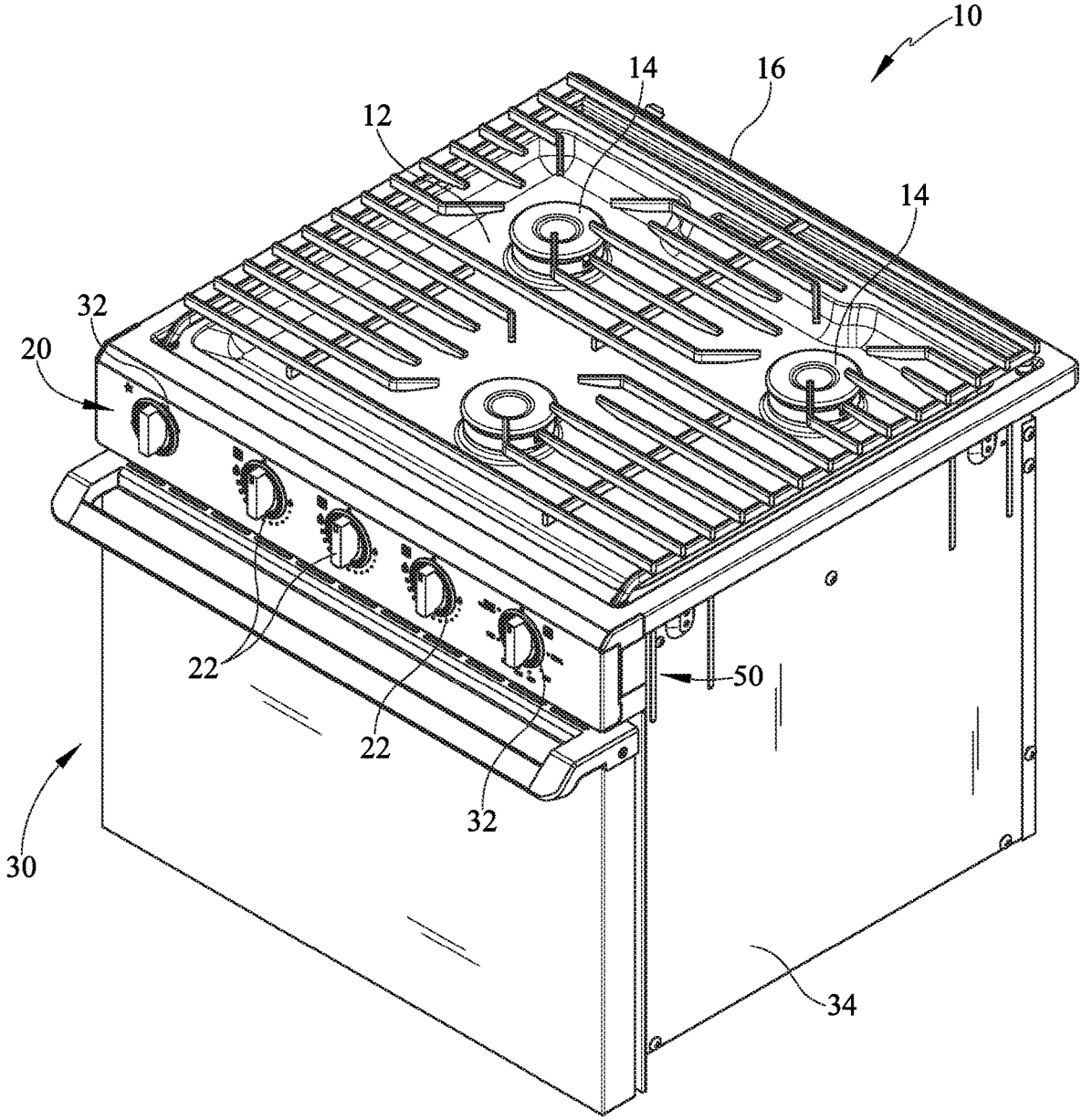
FIG. 1 is a perspective view of a stove for use in an RV or marine vehicle.

It is to be understood that a stove is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now to FIGS. 1-10, the present embodiments provide for end caps for a stove which may be installed in either of a countertop mount or recessed configuration and which may accommodate two configurations of a countertop edge. Some countertops may extend into the envelope of the stove while others may be flush fit against an outer edge of the stove. Either installation type has in the past, required a separate stove design. However, present embodiments provide a single design which may be accommodated for either type of installation. Further, the installation may also be performed with or without an adjacent oven.

With reference now to FIG. 1, an upper perspective view of a stove 10 is depicted. The stove 10 may be utilized in mobile applications, for example, recreational vehicles and/or marine applications. In some embodiments, it may also be desirable to use this end cap and stove arrangement for fixed building oven installations. The stove 10 is depicted with an upper burner pan 12 having one or more burners 14 extending above an upper surface of the pan 12. Additionally, a stove grate 16 may be positioned to support one or more pots, pans, skillets, or the like over the one or more burners 14. The pan 12 may be flat or may be recessed as shown. The pan 12 is shown as generally square shaped, but alternatively may be other shapes as well. In the instant embodiment, a triangular pattern of three burners 14 is provided by way of non-limiting example. The grate 16 may have opening areas such that the flames may pass through the grate 16 while limiting heating of the grate 16 and thus directing the majority of the heat to the pan, skillet or other cooking utensil positioned on the grate 16 and above the burners 14. However, this is non-limiting as other numbers of burners and or grate openings may be utilized.

Figure 2:
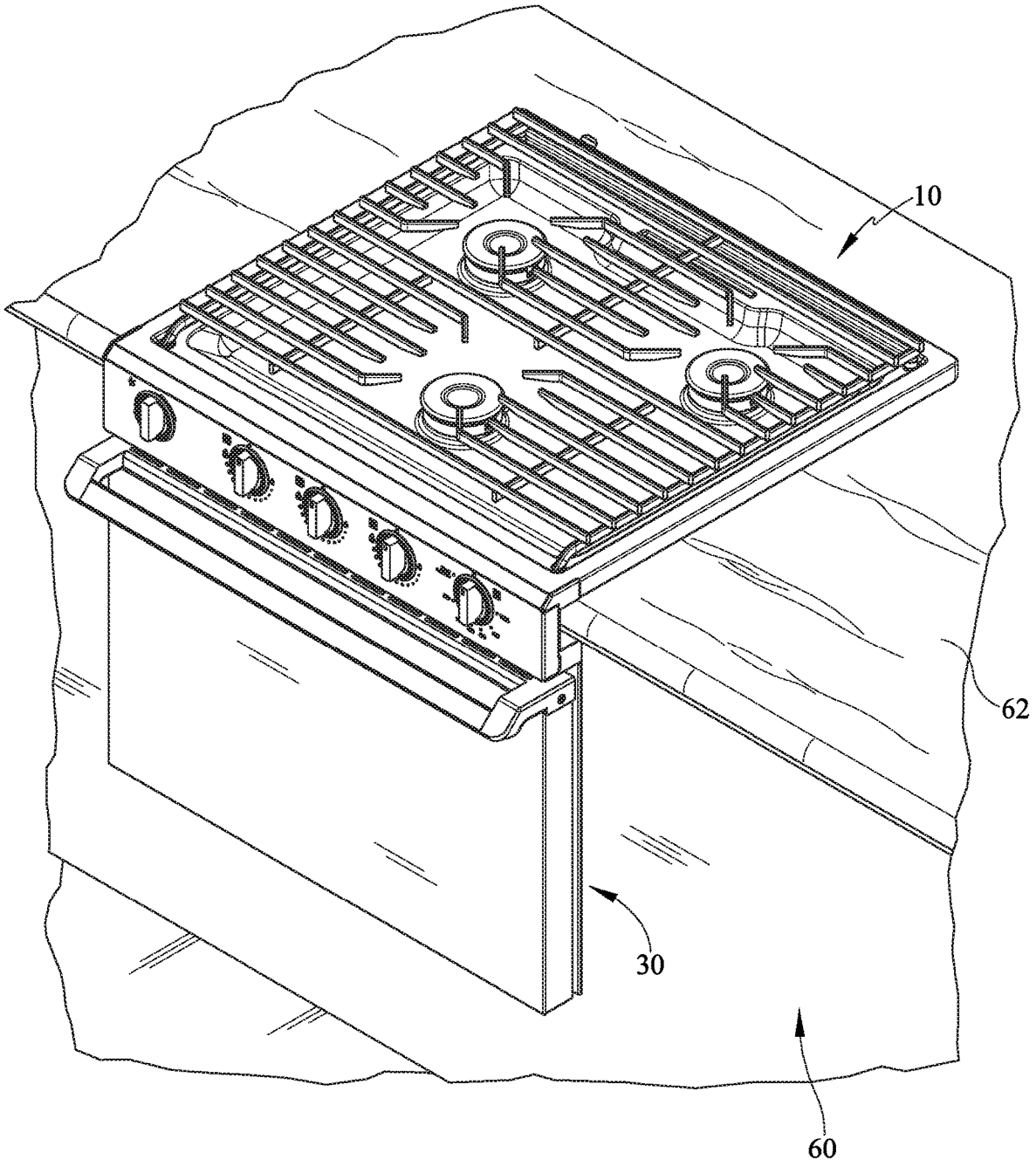
FIG. 2 is a perspective view of the stove mounted in a first configuration in a cabinet arrangement.

At the front of the pan 12, is a control panel 20. The control panel 20 has one or more gas control dials 22, corresponding to the number of burners 14 and/or burners and oven controls. The control panel 20 may be a vertically faced structure having openings wherein multiple gas control dials 22 are positioned corresponding to the burners 14. The control panel 20 may be a single structure extending across the front of the stove 10 and pan 12 or may be formed of a plurality of segments. Further, optionally, the control panel 20 may define a vertical boundary or portion of the stove 10 envelope. The gas control dials 22 may open and close gas valves which supply fuel to the burners 14. Additionally, one or more dials 32 may be also provided to adjust the heat level in an optional oven 30. The optional dials 32 may provide various settings for broiling, baking and the like in the oven 30. The oven 30 includes a housing 34 which is positioned within an arrangement of cabinets 60 (FIG. 2). The stove 10 may be connected to, or may be positioned above but disconnected from, the optional oven 30. In some embodiments, the stove 10 may be, for example, pivotally connected to the oven appliance housing 34 to allow for access or cleaning of the lower portion of the stove 10 if necessary. Further, however, the stove 10 need not be used with the oven 30.

Also shown in this view is an end cap 50 adjacent to an end of the control panel 20. The end cap 50 and the control panel 20, along with other structure may define an outer boundary or envelop for the stove 10. The end cap 50 provides for a structural arrangement to allow for positioning relative to the various types of countertop installations. For example, some countertops are installed with a lip or overhang relative to the cabinet arrangement where a recess is formed for the stove 10. In other configurations, the countertop edge may be flush with the vertical edge of the cabinet.

The pan 12 and the control panel 20 define a generally L-shaped structure when viewed from the side. The end cap 50 is positioned behind the control panel 20 and partially above it in order to match the geometry of the side profile of the burner pan 12 and the control panel 20 when assembled. Additionally, the end cap is disposed behind the control panel 20 defining the outer boundary of the front area of the stove.

Referring now to FIG. 2, a perspective view of the stove 10 and the oven 30 is depicted. The appliances are positioned within a cabinet arrangement 60 having a countertop 62 thereon. In this embodiment, the upper edge of the countertop 62 extends into the opening wherein the stove 10 is positioned. The cabinet arrangement 60 is shown as having a planar, vertical surface but this is generally representative of any type of cabinets which may also include doors, openings and/or drawers as one skilled in the art will understand. Thus, the cabinet arrangement 60, which is depicted, is merely illustrative and non-limiting.

The depicted installation is known as a countertop mount wherein the stove 10 is positioned in an opening of the countertop 62 and slides rearwardly and may be supported by the countertop surface. In such installation, due to the edge of the countertop 62 extending into the appliance opening supporting the stove 10 or at least extend into an envelope of the stove 10, the design of the stove 10 must allow clearance for the countertop 62 to extend underneath or beyond an outer most edge of the stove 10 in order to provide the desired support. Alternatively, an alternate design for the outer edge of the countertop 62 had to be provided for the depicted type of installation versus that shown in FIG. 4 and described further herein.

Figure 3:
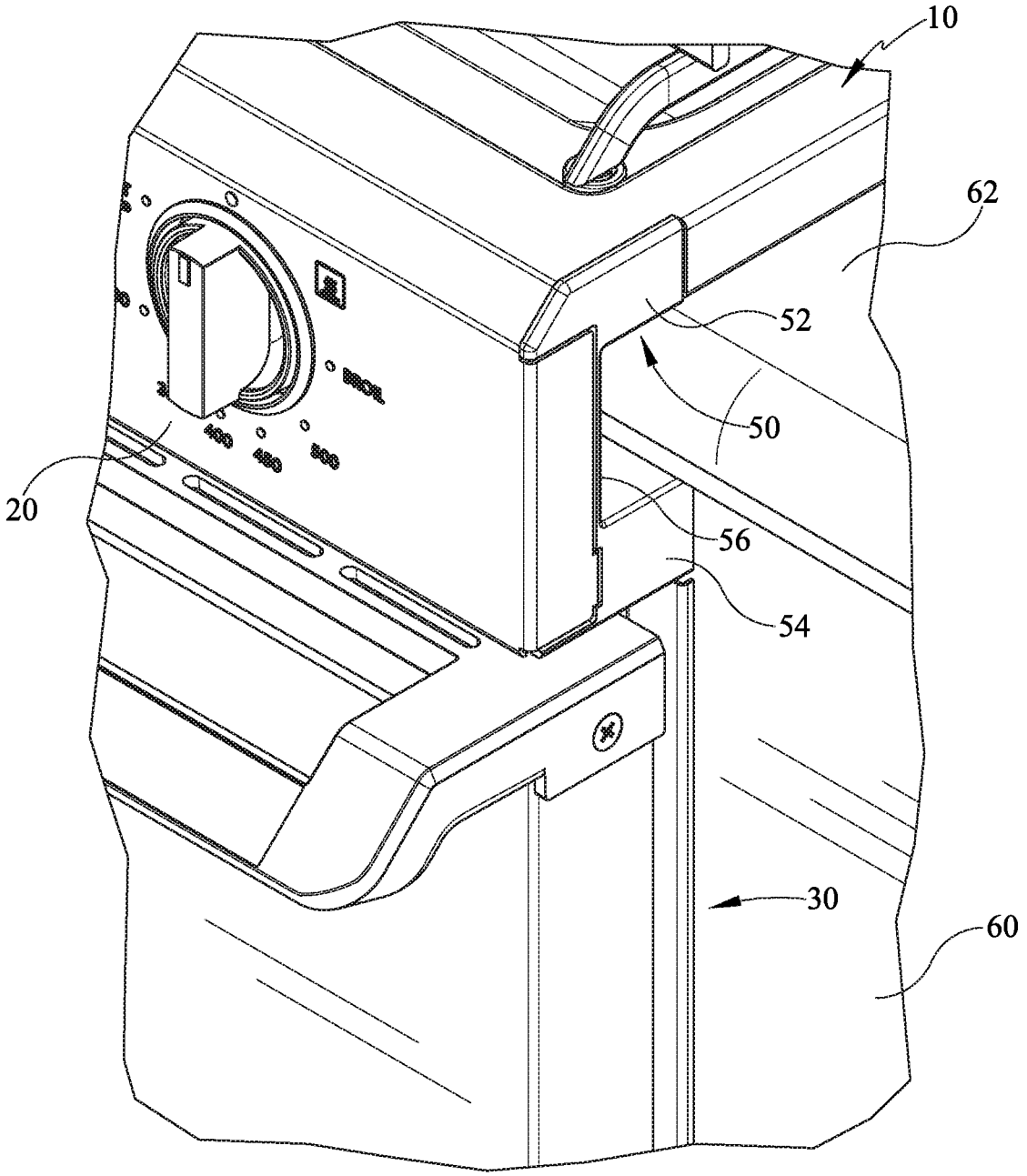
FIG. 3 is a detailed perspective view of the configuration of FIG. 2.

Referring now to FIG. 3, a detailed perspective view of the installation of FIG. 2 is depicted for purpose of explanation. As depicted, the stove 10 is shown supported by the countertop 62 and/or engaging the countertop 62. The end cap 50 is positioned along the outer edge of the stove 10 and also vertically along the control panel 20. The end cap 50 defines a recess wherein the countertop 62 may continue to extend into the outer envelope or boundary of the stove 10 as the countertop 62 does around the outer perimeter of the rest of the stove 10, according to the installation method.

The end cap 50 is generally C-shaped and has an upper leg 52, a lower leg 54 and a vertical leg 56. As shown in the view of FIG. 3, the end cap 50 may have a substantially C-shaped side view appearance which allows for the outermost countertop edge to extend into the envelope of the stove 10 rather than requiring a notch or a cut to the countertop 62 to allow for a change in profile of the stove 10. Thus the opening of the c-shaped end cap 50 allows for clearance of the countertop 62 to be positioned therein.

Figure 4:
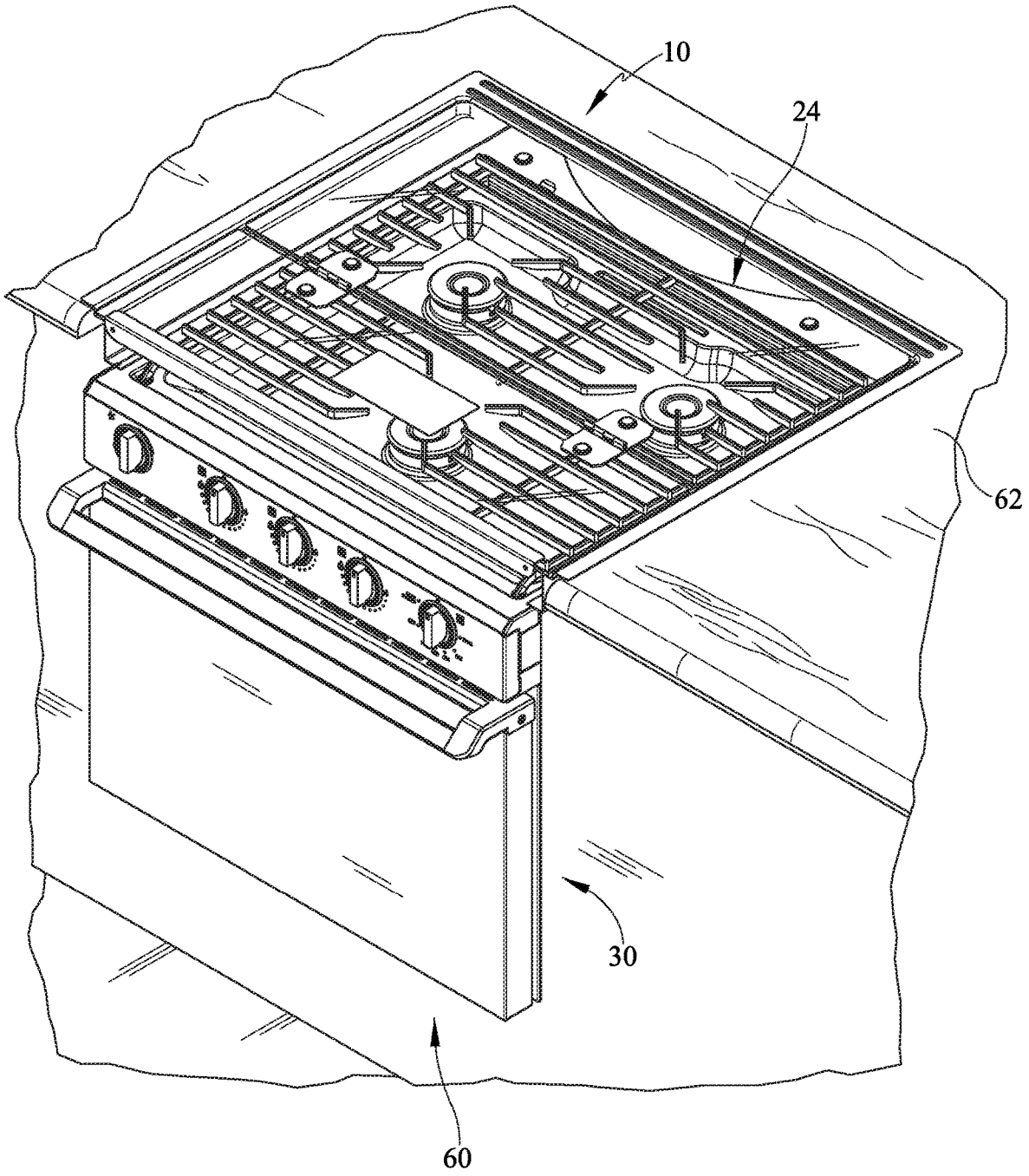
FIG. 4 is an upper perspective view of the stove in a second configuration.

Referring now to FIG. 4, an alternate installation is depicted in perspective view. In this embodiment, the stove 10 is generally recess mounted. A stove cover 24 may also be provided in this configuration so that the cover 24, when folded down, covers the grate 16 and the cover is flush with, or close to flush, with the upper surface of the countertop 62. This creates additional countertop space when the cover is down and the stove is not being used. A recess mount is one that the cabinet arrangement 60 and the countertop 62 are cut and the stove 10 and oven 30 are positioned within the recess. More specifically, the countertop 62 does not have a lip or overhang within the recess area of the stove opening as in the previous embodiment. Accordingly, in this embodiment, the stove 10 is not supported by the countertop 62 although a flange or bracket, for example of the stove cover, may be used to cover any opening between the stove 10 and the edge of the recess formed in the countertop 62. Further, as shown at the front edge of the countertop 62 and the opening in the cabinet arrangement 60, the edges of the cabinet 60 and the countertop 62 are generally aligned vertically and flush mounted against the edges of the oven 30 and the stove 10. In this view, it is also shown that the front edge of the countertop 62 does not extend into the envelope or boundary of the stove 10.

Figure 5:
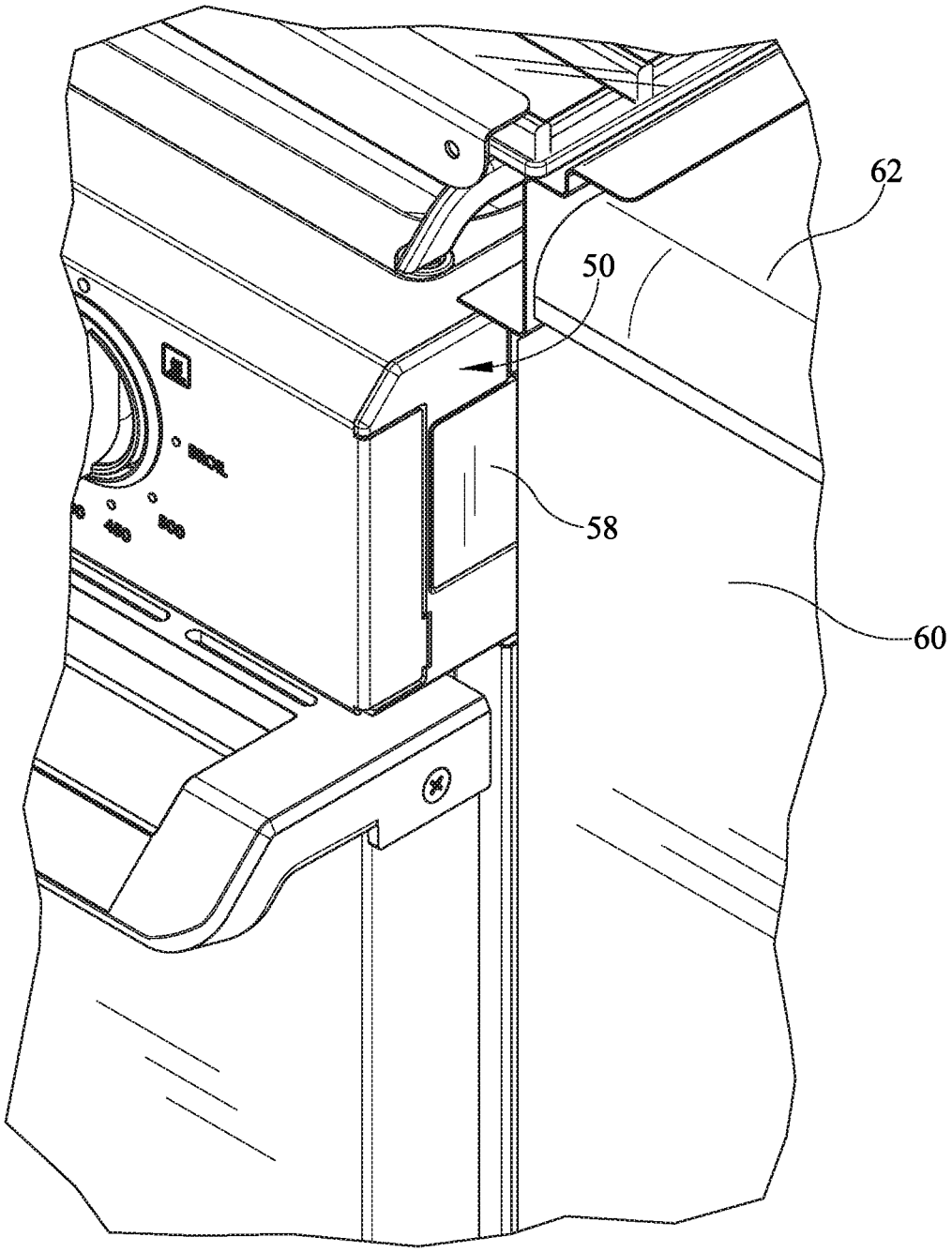
FIG. 5 is a detailed perspective view of the configuration of FIG. 4.

More to this point and with additional reference to FIG. 5, a detailed perspective view of the installation of FIG. 4 is shown. In this view, the end cap 50 is again shown, but instead of receiving an edge of the countertop 62 which may overhang the cabinet arrangement 60 in the appliance opening, as in FIGS. 2 and 3, the countertop 62 is cut with a vertical edge that is flush with the cabinet arrangement 60. Thus, the opening in the stove end cap 50 is not needed in this type of recess or flush mount installation. Accordingly, as shown in FIG. 5, cover plate 58 is positioned in the opening of the end cap 50 where the countertop 62 entered the end cap 50 in the previous embodiment. The embodiment provides that the cover plate 58 is fitted flush in the opening of the end cap 50 and therefore, no gaps or other openings, which are aesthetically unpleasant and unnecessary according to this embodiment are seen. The cover plate 58 also keeps food, debris or other contaminants from entering this area and collecting.

Figure 6:
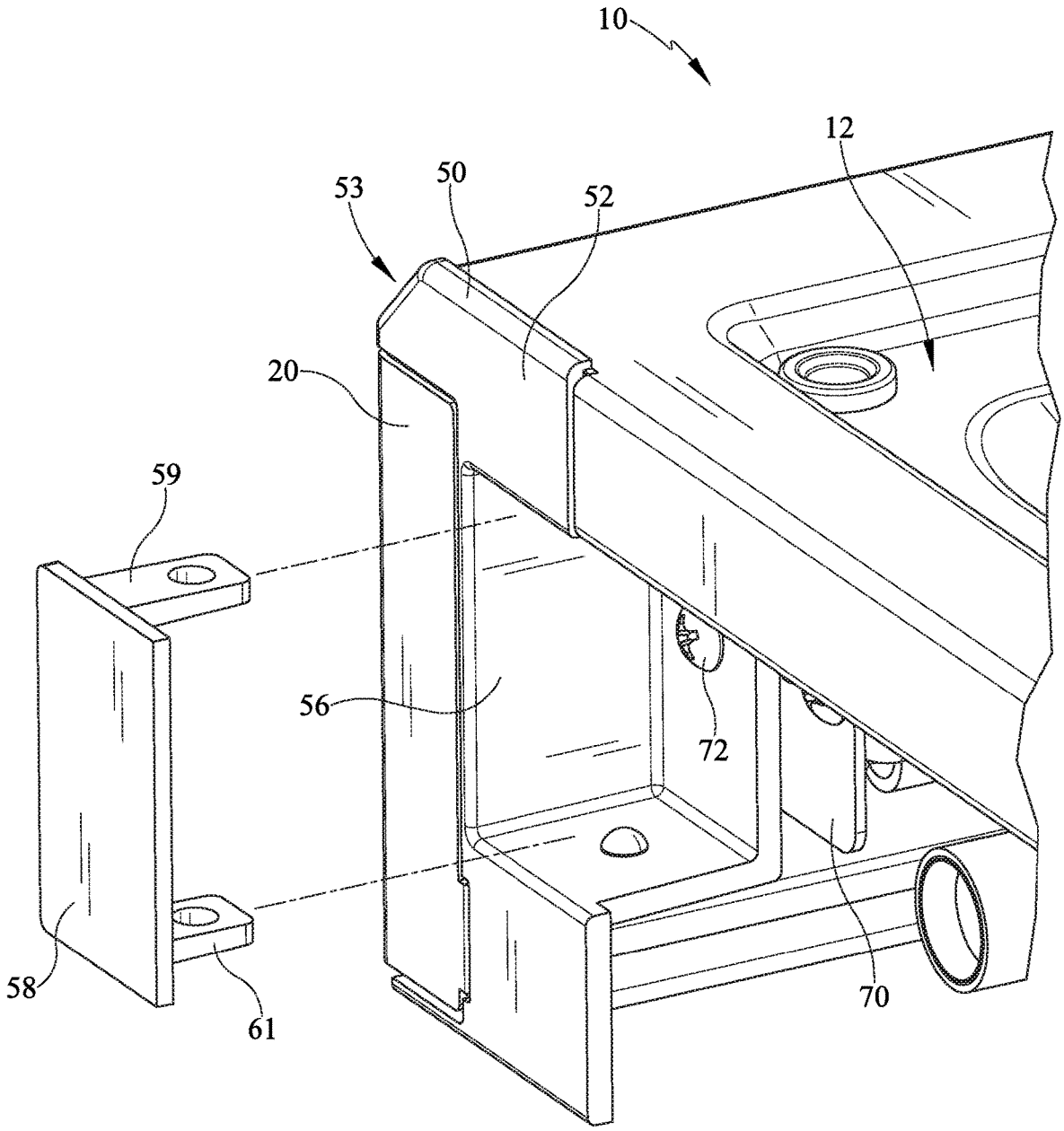
FIG. 6 is a detailed perspective view of the end cap and a cover plate exploded therefrom.

Referring now to FIG. 6, a perspective view of the stove 10 is depicted from a rear position looking forward along the side of the stove 10. The burner pan 12 is shown extending forward toward the control panel 20. The metal of the burner pan 12 and control panel 20 may have an open area or notch therebetween wherein an upper leg 52 of the end cap 50 is positioned. The stove 10 may comprise a chamfer, radius or other design feature 53 between the uppermost edge of the burner pan 12, which is horizontal, and the vertical face of the control panel 20. Accordingly, some embodiments of the end cap 50 may incorporate such design feature in order to match the profile of the stove 10 when viewed from the side. The instant embodiment provides that the end cap 50 and the control panel 20 includes such design feature 53, for instance a chamfer, extending from the uppermost edge of the upper leg 52.

Also shown more clearly in this view, is the general shape of the end cap 50 which has a vertical leg 56 on one side of the end cap 50, toward the control panel 20, but is open on the opposite side of the end cap 50. The open end of the end cap 50 allows for sliding rearwardly of the stove 10 and clearance to accept an overhanging edge of the countertop 62 (FIG. 2).

Also shown in the interior of the end cap 50 is a fastener 72 which allows for positioning of the end cap 50 against the stove 10 and specifically relative to a bracket 70 which supports the gas valve 25 (FIG. 7) for operation of the stove 10 and the oven 30.

Figure 7:
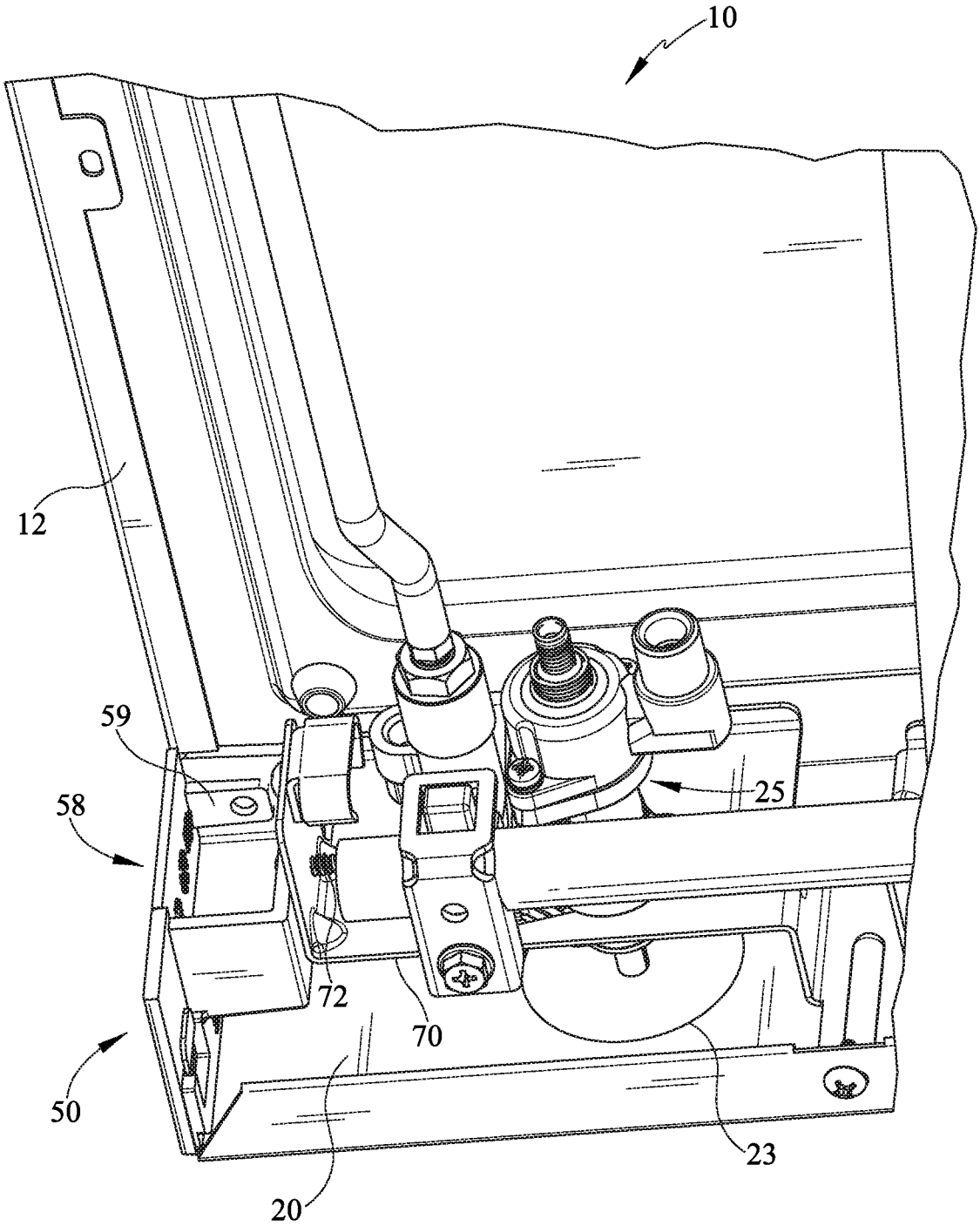
FIG. 7 is a lower rear perspective view of the control panel and end cap with the plate positioned therein.

Referring now to FIG. 7, a lower rear perspective view of the interior of the stove 10 is depicted beneath the burner pan 12. The control panel 20 is shown depending beneath the burner pan 12 and comprising openings 23 for the gas control dials 22 (FIG. 1). Each gas control dial 22 is provided with a valve 25 behind the control panel 20 and behind the opening 23. The valve 25 controls flow of fuel to a burner 14 (FIG. 1) or to the oven 30. The bracket 70 is provided to support each of the gas valves 25 and may also be utilized to provide a connection location for the end cap 50. As shown in the depicted view, the end cap 50 is connected to the bracket 70 by the fastener 72 extending through the open area of the end cap 50 and into the bracket 70. Such fastener 72 may be a screw, bolt, rivet or other connecting structure. Also, depicted in this embodiment is the cover plate 58 which is positioned in the end cap 50.

Figure 8:
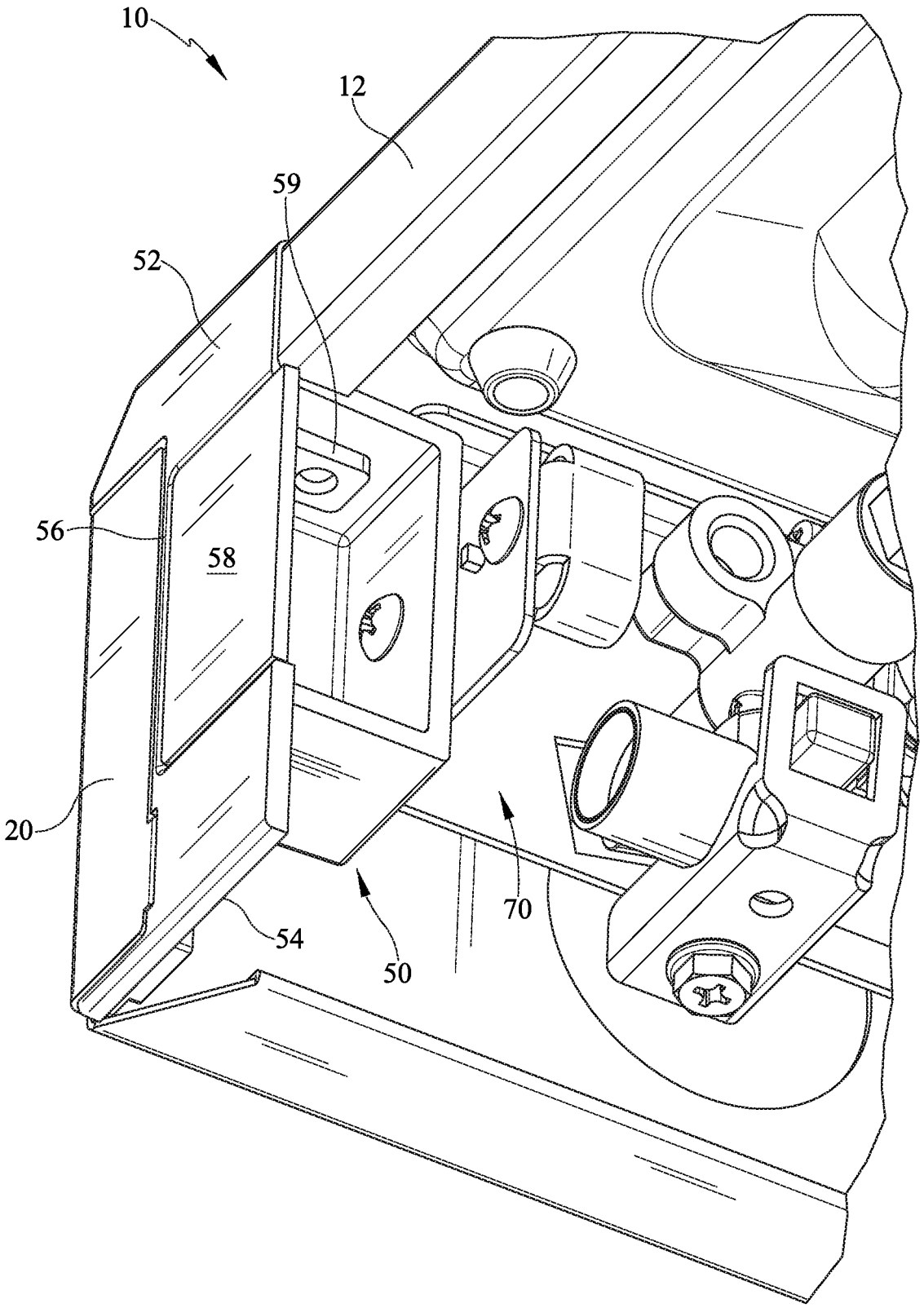
FIG. 8 is a lower perspective view of the end cap with the cover plate positioned therein.

Referring now to FIG. 8, a further lower perspective view of the end cap 50 positioned relative to the burner pan 12 and the control panel 20 is depicted. In this view, the three legs 52, 54, 56 of the end cap 50 are depicted. The opening of the end cap 50 is filled by the cover plate 58 and as shown in this view, and in combination with FIGS. 6 and 7, the cover plate 58 includes first and second arms 59, 61. Each of the arms 59, 61 may include a male or female connector wherein the adjacent portion of the end cap 50 may also include the other of the male and female connector to aid in retaining the cover plate 58 in the end cap 50, according to the installation shown in FIGS. 4, 5.

Figure 9:
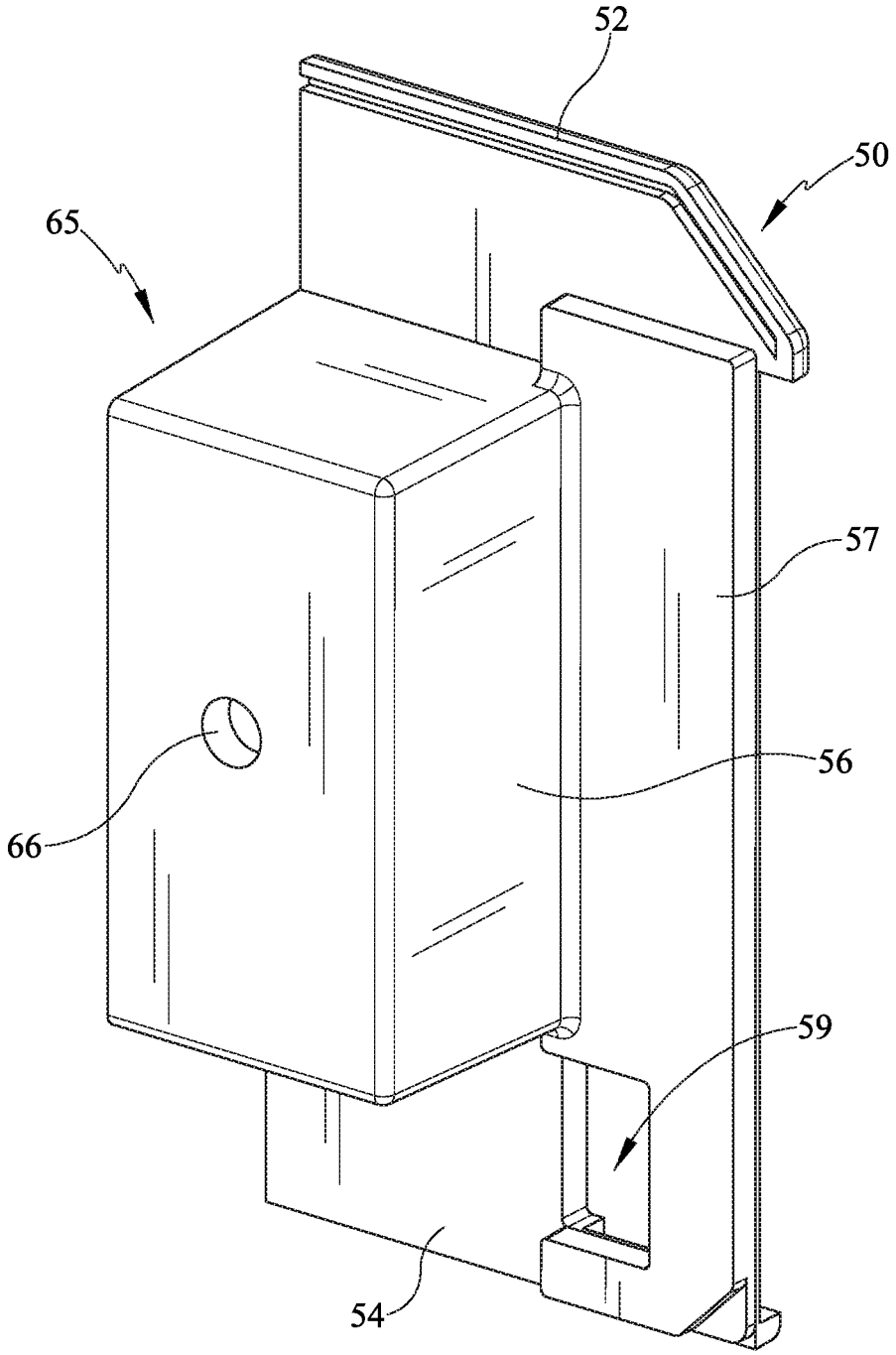
FIG. 9 is a rear perspective view of the end cap.

With reference now to FIG. 9, a rear perspective view of the end cap 50 is depicted. The legs 52, 54 and 56 are shown. In this view, a guide 57 is shown extending between the upper leg 52 and the lower leg 54. This guide 57 provides for positioning of an end wall of the control panel 20, as shown in FIG. 8, to fit flush with the outer surfaces of upper and lower legs 52, 54. The guide 57 may also provide stiffening for this outer surface of the control panel 20 along the ends and adjacent to the end cap 50. The guide 57 is offset to provide the clearance and allow the flush fit of the control panel end surface relative to the outer surfaces of legs 52 and 54. Further, the guide 57 may also provide an aperture 59 allowing a lock tab to extend through the aperture 59 and aid in retention of the end cap 50 in position, in addition to the fastener in bracket 70 (FIG. 8).

Extending from the rear of the legs 52, 54 and defining a portion of leg 56, is an enclosure 65. The side of the enclosure 65 which is not shown is open as shown in FIGS. 6-8 to provide clearance and allow the positioning of the countertop therein. The rear of the enclosure 65 also shows a fastener aperture 66, which may be connected to the bracket 70, also aiding to retain the end cap 50 in position. The enclosure 65 may be sized depending upon an amount offset by which the countertop 62 extends beyond the vertical edge of the cabinet arrangement 60. Thus if 1 inch thick countertops with ¾ inch overhang are anticipated, this may be determinative of the size of the enclosures, for example.

Figure 10:
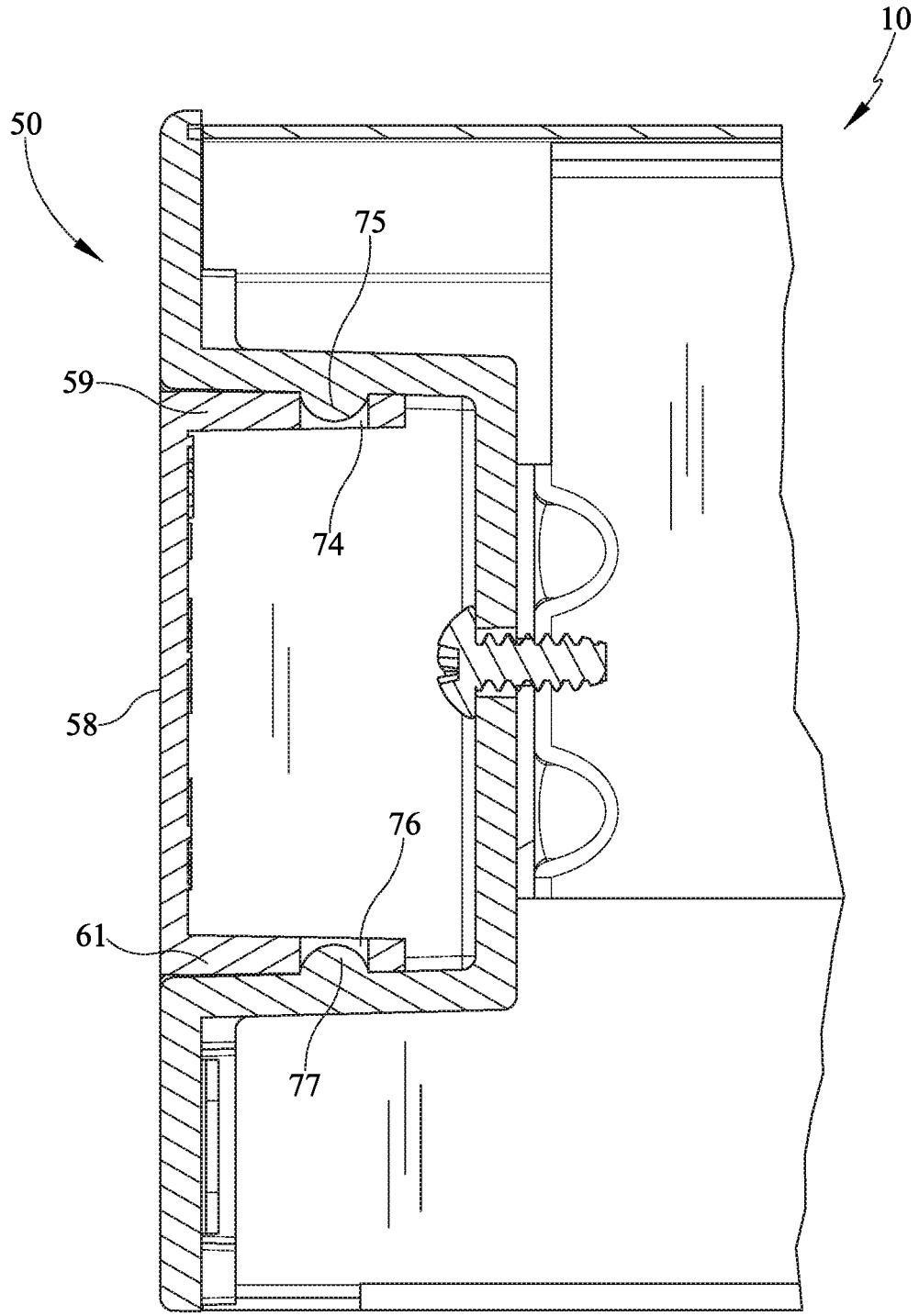
FIG. 10 is a side section view of the end cap installed in the stove.

Referring now to FIG. 10, a section view of the end cap 50 and stove 10 is depicted. The view shows the cover plate 58 positioned in the end cap 50 and further comprising connectors 74, 76 which engage opposed connectors 75, 77 of the end cap 50. In the instant embodiment, the connectors 75, 77 are male structures such as ribs or protuberances. The female connectors 74, 76 of the opposed structures may be reversed or additionally other connecting structures may be utilized such as latches, catches, or other engaging structures or other retaining features. Thus, these are not limited descriptions and various features may be utilized.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A stove, comprising:

an appliance housing configured to be positioned within an opening in a cabinet arrangement;

a pan having a plurality of burners;

a front facing control panel, having a plurality of valve controls adjacent to said front facing control panel;

an end cap disposed near at least one end of the control panel, said end cap having an opening;

wherein in one configuration, said opening can receive an edge of a countertop and in a second configuration, said opening may be closed with a plate for a flush fit of said edge of said countertop or the cabinet arrangement;

a first arm and a second arm extending from a rear surface of said plate; and, at least one connector to retain said plate in said second configuration.

2. The stove of claim 1, wherein said opening is formed in an enclosure.

3. The stove of claim 2, wherein said edge of said countertop passes through an outer vertical plane defined by said end cap and said opening.

4. The stove of claim 1 further comprising a second end cap.

5. The stove of claim 4 further comprising a bracket which is positioned near ends of said control panel, said bracket connected to said end cap and said second end cap.

6. The stove of claim 1, said end cap having one of a male or female connector and the first and second arms having the other of said male or female connector.

7. The stove of claim 1, wherein said end cap has a design feature which matches a design feature of one of a burner pan or said control panel.

8. The stove of claim 7, wherein said design feature is a chamfer.

9. The stove of claim 1, said end cap having a stiffening feature.

10. The stove of claim 1, said end cap having an enclosure which is covered by said plate.

11. A stove, comprising:

an appliance housing configured to be positioned within an opening in a cabinet arrangement;

a pan having a plurality of burners;

a front facing control panel, having a plurality of valve controls adjacent to said front facing control panel;

an end cap disposed near at least one end of the control panel, said end cap having an opening;

wherein in one configuration, said opening can receive an edge of a countertop and in a second configuration, said opening may be closed with a plate for a flush fit of said edge of said countertop or the cabinet arrangement;

said end cap having one of a male or female connector and the plate having the other of said male or female connector.

12. A stove, comprising:

an appliance housing configured to be positioned within an opening in a cabinet arrangement;

a pan having a plurality of burners;

a front facing control panel, having a plurality of valve controls adjacent to said front facing control panel;

an end cap disposed near at least one end of the control panel, said end cap having an opening;

wherein in one configuration, said opening can receive an edge of a countertop and in a second configuration, said opening may be closed with a plate for a flush fit of said edge of said countertop or the cabinet arrangement;

wherein a bracket retains valves in position relative to said control panel and valve controls.

* * * * *